US005740265A

United States Patent [19]

Shirakawa

[11] Patent Number: 5,740,265

[45] Date of Patent: Apr. 14, 1998

[54] LOUDSPEAKER UNIT AND LOUDSPEAKER SYSTEM EMPLOYING THE UNIT

[75] Inventor: Hidetoshi Shirakawa, Akishima, Japan

[73] Assignee: Foster Electric Co. Ltd., Tokyo, Japan

[21] Appl. No.: 773,235

[22] Filed: Dec. 23, 1996

[30] Foreign Application Priority Data

Dec. 26, 1995 [JP] Japan ..... 7-351841

[51] Int. Cl.[6] ..... H04R 25/00

[52] U.S. Cl. ..... 381/199; 381/194; 381/195; 381/205

[58] Field of Search ..... 381/199, 194, 381/205, 188, 195

[56] References Cited

U.S. PATENT DOCUMENTS 4,914,707 4/1990 Kato et al. .

*Primary Examiner*—Sinh Tran

*Attorney, Agent, or Firm*—Leydig, Voit & Mayer, L

[57] ABSTRACT

A loudspeaker unit includes a magnetic system of dual magnetic gaps formed with a permanent magnet disk carrying on both sides top and bottom plates and a cylindrical yoke surrounding the plates to form therebetween upper and lower magnetic gaps, and a vibratory system formed with a cylindrical voice coil bobbin carrying upper and lower voice coils for use in the dual magnetic gaps as disposed in half off-set state with respect to the gaps and a diaphragm coupled to upper end of the bobbin, the bobbin being supported by upper and lower dampers with respect to the magnetic system for vibration in axial directions of the magnetic system, allowing the bobbin to be supported at fulcrums positioned above and below voice-coil driving points.

5 Claims, 2 Drawing Sheets

LOUDSPEAKER UNIT AND LOUDSPEAKER SYSTEM EMPLOYING THE UNIT

BACKGROUND OF THE INVENTION

This invention relates to a loudspeaker unit capable of reproducing sufficiently low range sound with a simple structure, and to a loudspeaker system employing such loudspeaker units.

DESCRIPTION OF RELATED ART

It is not easy to cover the whole range of the audio-frequency spectrum with only a single loudspeaker, and there have been taken measures in which sound reproduction of lower frequency ranges is allotted to a large diametered loudspeaker unit and that of higher frequency ranges is allotted to a smaller diametered loudspeaker unit. In the auditory sense, there is a difference in the sense of sound depending on the sense of volume in high, middle and low ranges, respectively, and there has been provided a three-way system, for example, employing one or more loudspeaker units comprising an woofer in charge of the low range, a squawker in charge of the middle range, and a tweeter in charge of the high range.

In an event where a single loudspeaker unit has been used and, in particular, where the loudspeaker unit is of a smaller diameter, however, there has been a problem that a sufficient reproduction of low range sound is not attainable, while so-called high-fidelity equipment employing the three-way or multiway loudspeaker system involves a problem that the equipment has been required to be of extremely large dimensions and to be expensive.

SUMMARY OF THE INVENTION

It is an object of the present invention to provide a loudspeaker unit which eliminates the foregoing problems and enables reproduction of the low range sound with sufficient driving range and withstanding and input even when the diameter is small.

It is another object of the present invention to provide a loudspeaker system employing the above loudspeaker unit.

In order to attain a longer range of uniform driving force, and sufficient driving range and withstand input in a loudspeaker unit having a single magnetic gap, further, it has been required to increase the length of voice coil and magnetic gap as well, which eventually lowers the magnetic flux density. Further problems have been that the increased length of the voice coil results in a positional separation between a fulcrum and the driving point of the voice coil of the increased length, and the single fulcrum leaves a problem that the single fulcrum cannot easily retain the center.

While U.S. Pat. No. 4,914,707 to Kato et al suggests to obtain a uniform driving force with a dual magnetic gap circuit and a voice coil unit adapted to the dual magnetic gap circuit, a further improvement has been demanded in order to realize a longer range of uniform driving force, and sufficient driving range and sufficient withstand input, by means of an original disposition of the dual magnetic gap circuit, voice coil unit and any related members.

According to the present invention, the foregoing object can be realized by means of a loudspeaker unit comprising a dual magnetic gap circuit including a permanent magnet, top and bottom plates of the same thickness and disposed on both sides of the magnet and a yoke disposed on outer periphery of the magnet and plates to also act as a frame for forming upper and lower magnetic gaps; a voice coil bobbin for use with the dual magnetic gaps and carrying upper and lower voice coils mutually connected and wound in the same number of winding to be of the same width but in opposite winding direction, and a diaphragm mounted to upper end of the bobbin, the voice coil bobbin being supported by upper and lower dampers; characterized in that lower half of the upper voice coil is disposed in the upper magnetic gap, and upper half of the lower voice coil is disposed in the lower magnetic gap, for rendering the magnetic driving force to be constant irrespective of the level of vibratory amplitude.

According to the present invention, with the above arrangement, it is possible to attain the longer range of uniform driving force, and sufficient driving range and withstand input.

Further according to the present invention, the foregoing object can be established by a characteristic arrangement of the dual magnetic gaps including the upper magnetic gap with respect to the top plate and the lower magnetic gap with respect to the bottom plate.

Still according to the present invention, supporting fulcrum points of the voice coil bobbin, that is, mounting points of the dampers to the bobbin can be disposed to be above and below driving points of the voice coils, even when the fulcrum points of the bobbin and the driving points of the coils are mutually separated, and the fulcrum points can be easily set.

In addition, according to the present invention, the yoke has an integral structure with an outer peripheral ring of the magnetic gaps, so that slight gaps between the voice coils and the yoke can be formed for the width of the voice coils, and any air flow between both sides of the plates can be cut by means of viscosity resistance of air even when there is no edge connecting the yoke and diaphragm. With this edgeless structure, any restriction of edge with respect to amplitude or any influence on the linearity in the operation of vibratory system can be eliminated. Further, as the speaker unit is surrounded by the frame and outer peripheral ring, any magnetic leakage to the exterior is minimized.

Other objects and advantages of the present invention shall become clear as the description of the invention advances as detailed with reference to the embodiments shown in the accompanying drawings.

While the present invention should be described with reference to the embodiment shown in the accompanying drawings, it should be appreciated that the intention is not to limit the invention only to the embodiment shown but rather to include all alterations, modifications and equivalent arrangements possible within the scope of appended claims.

DETAILED DESCRIPTION OF THE PREFERRED EMBODIMENTS

An embodiment of the present invention shall be described with reference to the drawings.

Figure 1:
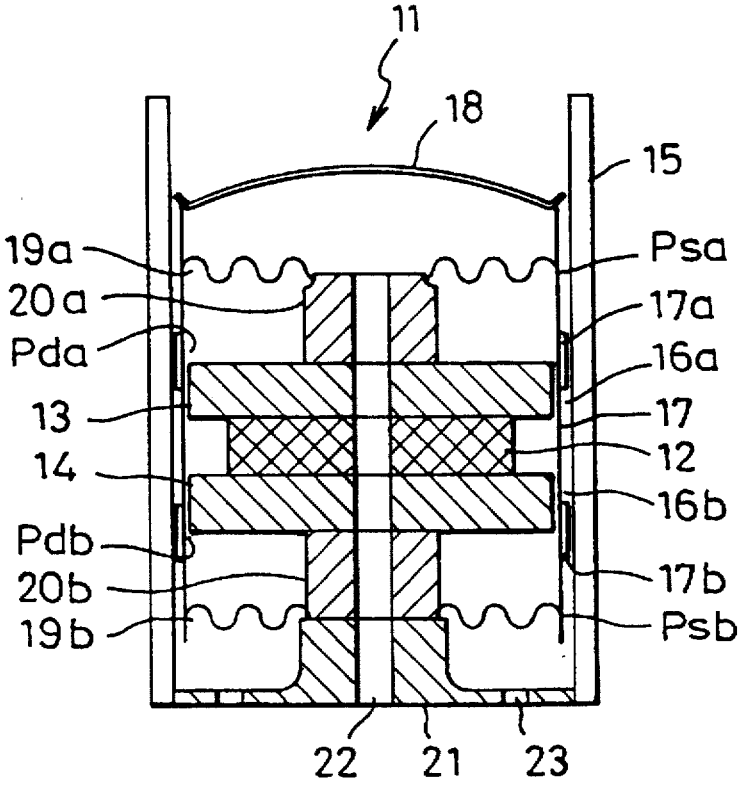
FIG. 1 shows in a sectioned view an embodiment of the loudspeaker unit according to the present invention.

FIG. 1 is a sectioned view of the loudspeaker unit in the embodiment according to the present invention, in which the loudspeaker unit 11 comprises a permanent magnet disk 12, and top and bottom plates 13 and 14 of the same thickness and disposed on both sides of the magnet disk 12. On the outer periphery of them, a yoke 15 also acting as a frame is provided, and a dual magnetic gap circuit comprising an upper magnetic gap 16*a* and a lower magnetic gap 16*b* is provided. Then, a voice coil bobbin 17 for use with the dual magnetic gaps and carrying upper and lower voice coils 17*a* and 17*b* mutually connected as wound in the same number of windings to be of the same width but made opposite in the winding direction is provided, while a diaphragm 18 is mounted to the top of the voice coil bobbin 17 and upper and lower dampers 19*a* and 19*b* support the voice coil bobbin 17, so that lower half of the upper voice coil 17*a* will be inserted in the upper magnetic gap 16*a* and upper half of the lower voice coil 17*b* will be inserted in the lower magnetic gap 16*b*, so as to render magnetic driving force to be constant irrespective of vibratory amplitude.

More specifically, the magnetic circuit of the loudspeaker unit 11 of the present invention is formed by providing the top and bottom plates 13 and 14 on the upper and lower sides of the magnetic disk 12, and disposing the yoke 15 on the outer periphery of the disk 12 and plates 13 and 14 to form the dual magnetic gaps including the upper and lower magnetic gaps 16*a* and 16*b*, as will be appreciated.

Further, since the upper and lower voice coils 17*a* and 17*b* are disposed in a half off-set state with respect to the upper and lower magnetic gaps 16*a* and 16*b* of the dual magnetic gap circuit, lower half of the upper voice coil 17*a* is positioned in the upper magnetic gap 16*a* while upper half of the lower voice coil 17*b* is positioned in the lower magnetic gap 16*b*.

The upper damper 19*a* is connected at its inner edge to an upper damper support 20*a* provided on the top plate 13 and supports at its outer peripheral edge an upper part of the voice coil bobbin 17, whereas the lower damper 19*b* is connected at its inner edge to a lower damper support 20*b* provided on the bottom plate 14 and supports at its outer peripheral edge a lower part of the voice coil bobbin 17. The diaphragm 18 is mounted on the top end of the voice coil bobbin 17. A base 21 of the loudspeaker unit 11 is provided to support an assembly of the magnet 12, top and bottom plates 13 and 14 and upper and lower damper supports 20*a* and 20*b* and is fixed to bottom end edge of the yoke 15. An axial through hole 22 penetrates through the assembly and the base 21 to provide communication between a space between the inner face of the diaphragm 18 and the upper damper 19*a* and its support 20*a* with the exterior of the base 21, and through holes 23 made in the base 21 provide communication of the space between the lower damper 19*b* and the base 21 with the exterior of the base 21.

The upper voice coil 17*a* is provided for being driven with a driving point Pda as the center, which point being adjacent to lower peripheral edge of the top plate 13, and the lower voice coil 17*b* is provided for being driven with a driving point Pdb as the center, which point being adjacent to upper peripheral edge of the bottom plate 14. Irrespective of the level of vibration amplitude, the sum of the respective numbers of windings of the upper voice coil 17*a* within the upper magnetic gap 16*a* and of the lower voice coil 17*b* within the lower magnetic gap 16*b* is always constant and no variation is yielded in the driving force.

The loudspeaker unit 11 according to the present invention disposes the upper and lower voice coils 17*a* and 17*b* of the voice coil bobbin 17 in the half off-set state with respect to the upper and lower magnetic gaps 16*a* and 16*b*, and also disposes the dual voice coils 17*a* and 17*b* with respect to such dual magnetic gaps 16*a* and 16*b*. As a result, it has been found to be capable of elevating the driving efficiency by 15% as compared with a conventional inner magnet type magnetic circuit, and also of prolonging the range for which the driving force is uniform, by the off-set positioning of the dual voice coils 17*a* and 17*b* with respect to the dual magnetic gaps 16*a* and 16*b*. Further, by supporting the voice coil bobbin 17 of the dual magnetic gap at two positions, at the upper and lower parts of the bobbin by the two dampers 19*a* and 19*b*, the vertical symmetry is improved in the operation of the vibratory system. Further, by integrating the yoke 15 with the outer peripheral ring of the upper and lower magnetic gaps 16*a* and 16*b*, the invention contributes remarkably to extending the vibratory amplitude range, and in increasing effective vibratory area, improving the vertical symmetry and linearity, and reduces magnetic leakage.

Figure 2:
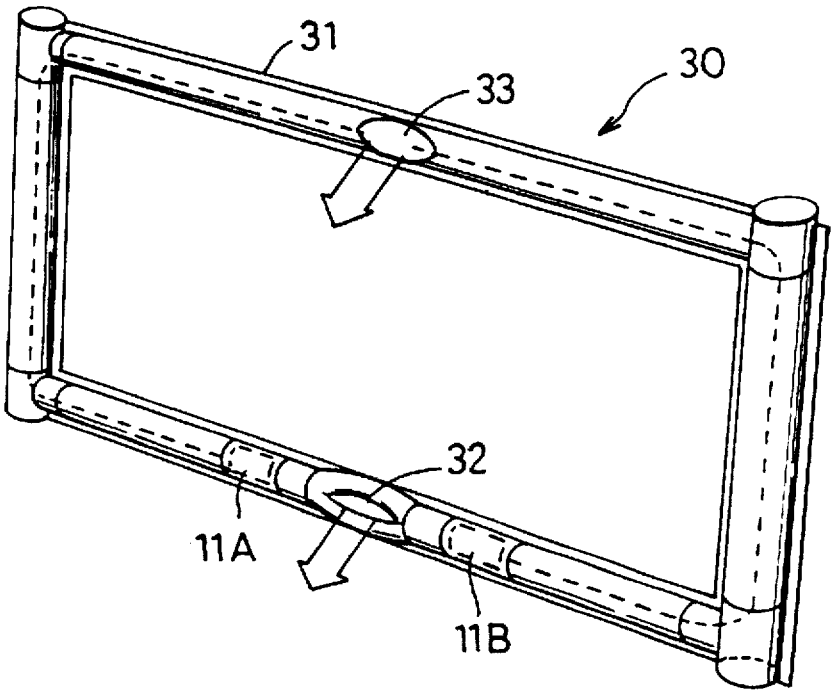
FIG. 2 shows in a perspective view a loudspeaker system according to the present invention.
Figure 3:
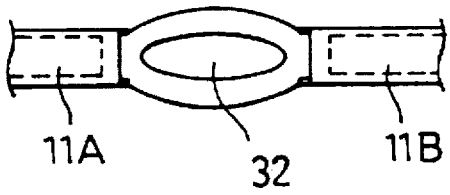
FIG. 3 is a fragmentary magnified plan view of the loudspeaker system of FIG. 2.

FIG. 2 shows in a perspective view a loudspeaker system 30 in an embodiment in which the foregoing loudspeaker unit 11 is employed, and FIG. 3 is a fragmentary magnified plan view of the system, in which the loudspeaker system 30 comprises a frame body 31 made in a rectangular shape from a relatively thin tubular duct which acts as a resonating pipe. An opening 32 is provided substantially in the center of lower side duct of the frame. A pair of the foregoing loudspeaker units 11A and 11B are disposed within the tubular duct on both sides of the opening 32 opposed to each other on their diaphragm side, for example, through the opening 32, and a further upper opening 33 is provided in the center of upper side duct of the frame.

In the present instance, the loudspeaker units 11A and 11B themselves are cylindrical in shape, and reproduced sound is radiated in both of forward and rearward directions. With the mutually opposing disposition of the loudspeaker units 11A and 11B on both sides of the opening 32, the sound radiated forward from each of the units collides with the sound radiated forward from the other unit. The mutually colliding sound is radiated out of the opening 32, while the sound pressure is raised and the frequency shifts to lower side. This is because the apparent mass is increased by the mutually overlapping sound from both loudspeaker units, so that a load air mass is increased as compared with a single loudspeaker unit, and thus characteristics are eventually improved.

The sound radiated rearward from both of the paired loudspeaker units 11A and 11B will be conveyed through the tubular duct of the frame body 31 and eventually radiated out of the upper opening 33, as shown in FIG. 2. The duct acts as the resonating sound pipe, to improve characteristics. With the sound radiation from both of the mutually separated openings 32 and 33, an improvement is also seen in the auditory sense.

On the other hand, the frame body 31 may be utilized as a framing of a television receiver or a liquid crystal display, or as a decorative frame of a painting or photograph when properly designed, and a new and original loudspeaker system can be realized.

What is claimed is:

1. A loudspeaker system comprising:

a pair of loudspeaker units disposed opposite to each other, each of the loudspeaker units including:

a magnet, first and second plates having the same thickness and disposed on opposite sides of the magnet, a yoke, acting as a frame, disposed at outer peripheries of the magnet and the first and second plates, a voice coil bobbin carrying first and second voice coils, mutually connected, having the same number of turns and the same width, but wound in opposite directions, the voice coil bobbin being disposed in first and second magnetic gaps formed between the first and second plates and the yoke, respectively, a diaphragm mounted on the voice coil bobbin, and first and second dampers supporting the voice coil bobbin wherein during a non-operational state only a half of the first voice coil proximate the magnet is disposed in the first magnetic gap and only a half of the second voice coil proximate the magnet is disposed in the second magnetic gap whereby magnetic driving force driving the diaphragm is constant regardless of vibratory amplitude of the diaphragm; and a hollow frame having opposed first and second sides with respective central openings in the first and second sides, the pair of loudspeaker units being disposed inside the frame for radiating from the central opening in the first side forward-reproduced sound emitted from both of the loudspeaker units and for radiating from the central opening in the second side rearward-reproduced sound emitted from both of the loudspeaker units.

2. The loudspeaker system according to claim 1, wherein the pair of loudspeaker units are disposed in the first side of the frame body on opposite sides of the central opening in the first side.

3. A loudspeaker unit comprising:

a magnet unit including a plate-shaped permanent magnet and first and second magnetizable plates having the same thickness and disposed on opposite first and second faces of the magnet;

a yoke surrounding the magnet unit and forming respective first and second magnetic gaps between outer peripheral faces of the first and second plates and an inner face of the yoke;

a voice coil bobbin disposed between the magnet unit and the yoke and carrying first and second voice coils wound on the bobbin, having equal numbers of turns and identical widths, but wound in opposite directions, the first and second voice coils being disposed respectively in the first and second magnetic gaps;

a diaphragm coupled at an outer periphery to an edge at an end of the voice coil bobbin proximate a first end of the yoke; and first and second dampers supported at an inner surface of the voice coil bobbin and respectively resiliently supported at opposite faces of the magnet unit wherein during a non-operational state only the halves of the first and second voice coils proximate the magnet are disposed within the first and second magnetic gaps, respectively, the first and second voice coils being disposed intermediate the first and second dampers.

4. A loudspeaker system comprising a pair of loudspeaker units opposite each other, each loudspeaker unit comprising:

a magnet unit including a plate-shaped permanent magnet and first and second magnetizable plates having the same thickness and disposed on opposite first and second faces of the magnet;

a yoke surrounding the magnet unit and forming respective first and second magnetic gaps between outer peripheral faces of the first and second plates and an inner face of the yoke;

a voice coil bobbin disposed between the magnet unit and the yoke and carrying first and second voice coils wound on the bobbin, having equal numbers of turns and identical widths, but wound in opposite directions, the first and second voice coils being disposed respectively in the first and second magnetic gaps;

a diaphragm coupled at an outer periphery to an edge at an end of the voice coil bobbin proximate a first end of the yoke;

first and second dampers supported at an inner surface of the voice coil bobbin and respectively resiliently supported at opposite faces of the magnet unit wherein during a non-operational state only the halves of the first and second voice coils proximate the magnet are disposed within the first and second magnetic gaps, respectively, the first and second voice coils being disposed intermediate the first and second dampers; and a magnetizable base plate coupled to the yoke at a second end opposite the first end and supporting the magnet unit, the magnet unit and the base plate having a central hole providing communication between an interior space intermediate the diaphragm and the first damper and exterior space outside the speaker unit, the base plate further including holes providing communication between an interior space intermediate the second damper and the base plate and the exterior space, sounds reproduced by the diaphragms of both loudspeaker units being superimposed between the loudspeaker units and radiated through the holes in the base plates in opposite directions.

5. A loudspeaker unit comprising:

a magnet unit including a plate-shaped permanent magnet and first and second magnetizable plates having the same thickness and disposed on opposite first and second faces of the magnet;

a cylindrical yoke surrounding the magnetic unit and forming respective first and second magnetic gaps between outer peripheral faces of the first and second plates and an inner face of the yoke;

a voice coil bobbin disposed between the magnet unit and the yoke and carrying first and second voice coils wound on the bobbin, having equal numbers of turns and identical widths, but wound in opposite directions, the first and second voice coils being disposed respectively in the first and second magnetic gaps;

a diaphragm coupled at an outer periphery to an edge at an end of the voice coil bobbin proximate a first end of the yoke;

first and second dampers supported at an inner surface of the voice coil bobbin and respectively resiliently supported at opposite faces of the magnet unit, the first and second voice coils on the magnetic unit being disposed intermediate the first and second dampers; and a magnetizable base plate coupled to the yoke at a second end opposite the first end and supporting the magnet unit, the magnet unit and the base plate having a central hole providing communication between an interior space intermediate the diaphragm and the first damper and exterior space outside the speaker unit, the base plate further including holes providing communication between an interior space intermediate the second damper and the base plate and the exterior space.

* * * * *